US005155309A

United States Patent [19]

Dwyer

[11] Patent Number: 5,155,309

[45] Date of Patent: Oct. 13, 1992

[54] PNEUMATIC ACTUATOR FOR A PATIENT CALL SYSTEM

[75] Inventor: Phillip W. Dwyer, Jacksonville, Fla.

[73] Assignee: Dwyer Precision, Inc., Jacksonville, Fla.

[21] Appl. No.: 732,799

[22] Filed: Jul. 19, 1991

[51] Int. Cl.[5] ..... H01H 35/34

[52] U.S. Cl. ..... 200/81 H; 73/745; 200/333; 200/513; 200/83 Z; 340/573

[58] Field of Search ..... 340/573, 611, 614, 626, 340/666, 667; 73/723, 729, 730, 745; 307/118; 92/5 R, 34, 36; 128/721; 200/81 R, 333, 81, 82 R, 83 Z, 83 J, 85 R, 86 R, 505, 512, 513, 517, 515; 91/1

[56] References Cited

U.S. PATENT DOCUMENTS

| | | | |
|---|---|---|---|
| 3,781,843 | 12/1973 | Harrison | 200/81 H |
| 3,823,285 | 7/1974 | Dwyer | 200/81 H |
| 4,127,758 | 11/1978 | Lowthorp | 200/513 |
| 4,298,778 | 11/1981 | Beresford-Jones | 200/333 |
| 4,298,863 | 11/1981 | Natitus | 340/573 |
| 4,754,107 | 6/1988 | Tracey | 200/81 H |

FOREIGN PATENT DOCUMENTS

| | | | |
|---|---|---|---|
| 1299432 | 12/1972 | United Kingdom | 200/81 H |

*Primary Examiner*—Gerald P. Tolin
*Attorney, Agent, or Firm*—Clifford A. Poff

[57] ABSTRACT

A pneumatically actuated switching device comprises a pneumatic bulb including a base plate for anchoring the bulb by frictional contact with surfaces in contact therewith. The base plate further having pneumatic seal about an outer periphery thereof, and an actuator dome having a convexly extended pneumatic activation wall supported by an outer peripheral annular rim engaged with the base plate for pneumatic sealing with the seal to define a pneumatic pump chamber. The bulb further including a conduct for conducting a quantity of air pressurized by operation of the dome and, electrically conductive switch responsive to the discharge of a volume of air pressurized by the pneumatic bulb for producing a corresponding electrical signal. The activation wall of the dome includes a circular ring wall section having at the inside diameter thereof a depressed projecting central wall from where there extends a support post at the inside of the actuator dome for maintaining elasticity of the pneumatic pumping chamber acted on by the circular ring. The base plate includes an array of protrusions for anchoring of the pneumatic bulb.

8 Claims, 3 Drawing Sheets

PNEUMATIC ACTUATOR FOR A PATIENT CALL SYSTEM

BACKGROUND OF THE INVENTION

1. Field of the Invention

This invention relates to a pneumatically actuated switching device and more particularly to an improved construction and arrangement of parts to form a pneumatic bulb for delivering a quantity of pressurized air to a site remote from the bulb for triggering a switching device to produce an electrical signal in a nurse call system.

2. Description of the Prior Art

A pneumatically actuated bulb device is known in the art for a patient actuating a nurse call system and an example of such a device is disclosed in my prior art U.S. Pat. No. 3,823,285. The pneumatic bulb provides a source of pressurized air to operate an electrical switching circuit that is well suited for use in environments where it is undesirable to use a conventional electrical switch. The possibility exists of a catastrophic explosion when a conventual switching circuit operates in an atmosphere containing a high concentration of a potentially explosive gas. Such an atmosphere commonly occurs in hospital rooms due to a patient's use of oxygen. A patient actuated call system is not only commonly used in hospital rooms but also in other health care facilities where there is a need or desire by some person for help, particularly, when a patient is in a weakened or disabled condition. Most hospitals and health care institutions today have signalling systems by which in each patient area a patient may initiate a signal that is received of a station or at an allocated substation within a larger area to summon assistance. Typically, for example, in a hospital a select group of patient areas is serviced by a given nurse station where calls for assistance by patients are taken. Most patient areas must accommodate the use of oxygen even if it is only on an emergency base whereby electrical switches commonly used in other industries can not be utilized. The pneumatically operated switch disclosed in my aforesaid U.S. Pat. No. 3,823,285 provides an entirely satisfactory solution to the need for a pneumatically activated switching 10 device which can operate in a very reliable fashion in hostile environments. This switching device successfully operates in atmospheres containing a high concentration of oxygen that could otherwise cause combustion. A need, however, exists for a pneumatic bulb construction that is better suited for the environment of use particularly in a patient environment where patients can assume that the pneumatic device will remain in place without random or uncontrolled movement. For example, a pneumatic bulb having a spherical configuration or a configuration having hemispherically end parts adjoined with a cylindrical mid-section can not be relied upon to remain in a fixed or desired location on a patient's mattress so that the patient can utilize the bulb to summon help. The rounded configuration of the bulb and patient movement all contributed to the fact that the bulb will move randomly in an uncontrolled manner. Moreover, a need exists for a pneumatic bulb construction which will allow a pressurized air supply to be developed in a reliable manner requiring minimal effort on behalf of the operator of the pneumatic bulb.

Examples of other known nurse call systems can be found in U.S. Pat. Nos. 4,702,443; 4,484,367; 4,298,863; and 3,781,843. In U.S. Pat. No. 4,702,443, a cord holding device is disclosed wherein a belt fastener is used to hold a base onto a mattress so that the base can in turn receive a cord holding member. The cord holding member supports a cord to allow limited movement of the cord the end of which carries a push button electric switch. In U.S. Pat. No. 4,484,367, a side rail of a patients bed is wrapped with a flexible sheet having a pocket in one side of the sheet for receiving an electronic push button device serving as a call device for summoning a nurse. U.S. Pat. No. 4,298,863 discloses a patient call system in which a patient operated transducer is mounted on a patients face or a portion of the body. The transducer is interconnected by pneumatic tubing to an pneumatically actuated switch that is part of an electronic monitoring system. U.S. Pat. No. 3,781,843 discloses a bed guard system in which the upper rail surfaces of patient restraining rails at opposite sides of a bed are fitted with a detector. Each detector is formed with an elongated rail engaging pocket shape to fit on the rail surface and an overlying elongated internal cavity extending generally the length of the rail. In internal cavity forms a site for a fluid material which can be pressurized by an applied pressure to the top surface of the rail covering.

SUMMARY OF THE INVENTION

It is an object of the present invention to provide a pneumatic bulb embodying a construction that will allow the bulb to remain at a desired designated area with great reliability and integrity for operating a switching device to summon help or assistance by a patient in an area.

It is a further object of the present invention to provide a pneumatic bulb embodying a construction such that a base plate is utilized to provide a broad area of support for a peripheral rim and a center post of an actuator dome.

It is another object of the present invention to provide a pneumatic bulb embodying a generally annular ring configuration with a convexly shaped top wall resembling a doughnut appearance to provide distinctive identification to the bulb for distinction from other pneumatic bulbs that may be utilized for different purposes in a patient area.

More particularly, according to the present invention there is provided a pneumatically actuated switching device comprising a pneumatic bulb including a base plate for anchoring the bulb by frictional contact with surfaces in contact therewith, the base plate further having pneumatic seal means about an outer periphery of the base plate and an actuator dome having a convexly extended pneumatic activation wall supported by an outer peripheral annular rim engaged with the base plate for sealing with the seal means to define a pneumatic pump chamber, the bulb further including means for conducting a quantity of air pressurized by operation of the dome and, electrically conductive means responsive to the discharge of a volume of air pressurized by the pneumatic bulb for producing a corresponding electrical signal.

Preferably the convexly extended pneumatic activation wall includes a circular ring wall section having at the inside diameter thereof a depressed projecting central wall from where there extends a support post at the inside of the actuator dome for maintaining elasticity of the pneumatic pumping chamber acted on by the circular ring. The base plate preferably includes an array of protrusions for anchoring of the pneumatic bulb by friction. The protrusions comprise truncated conical members each having an extended height of about at least 80% of a corresponding cone height to thereby assure more effective friction contact with a support surface.

DESCRIPTION OF THE DRAWINGS

The present invention will be more readily understood when read in light of the accompanying drawings in which.

DETAILED DESCRIPTION OF THE PREFERRED EMBODIMENTS

Figure 1:
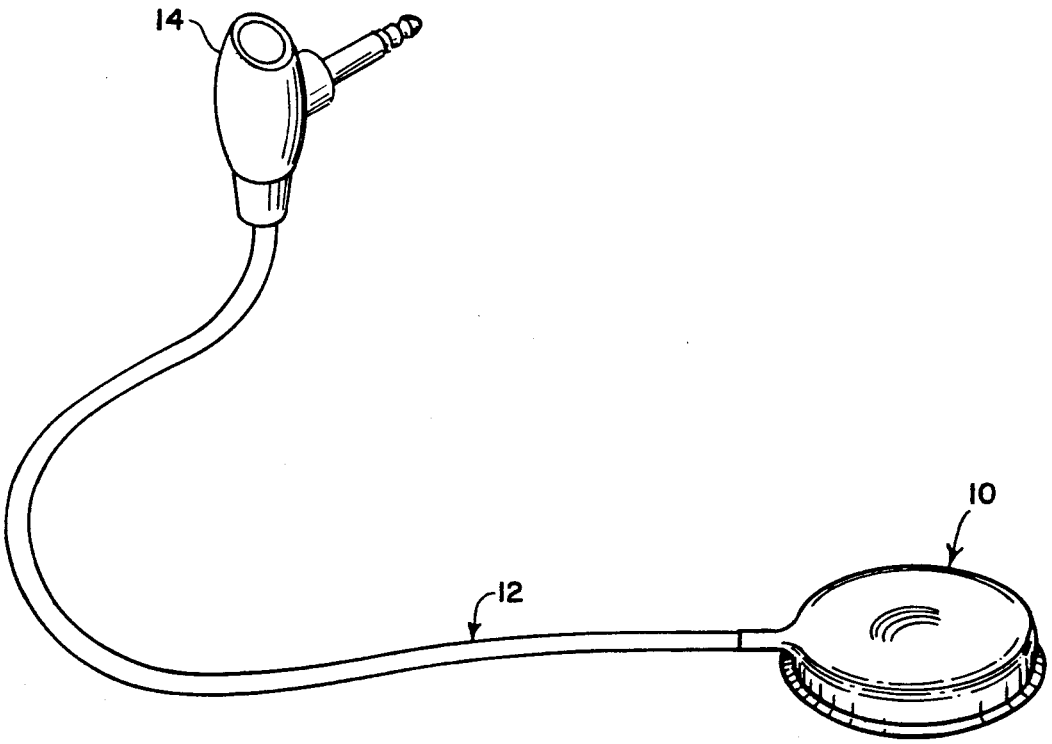
FIG. 1 is a perspective view of a pneumatically actuated switching device utilizing the improved pneumatic bulb according to the present invention.
Figure 2:
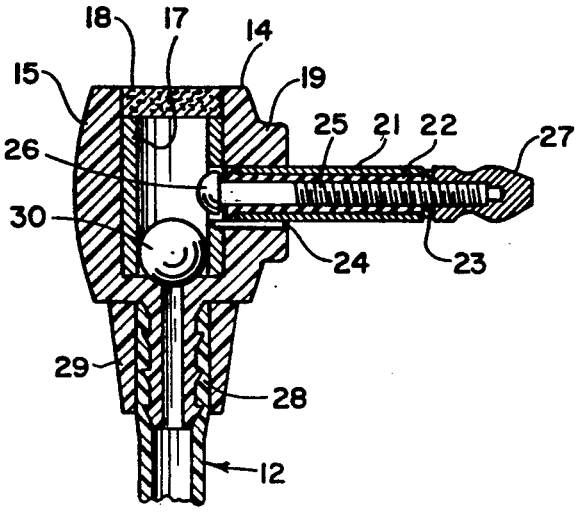
FIG. 2 is an enlarged sectional view of the pneumatically actuated switching device as shown in FIG. 1 with the actuator ball in a position for an open circuit.

In FIG. 1 there is illustrated the preferred embodiment of the present invention in which an actuator bulb 10 is connected by an air conduit 12 to a pneumatically actuated switching device 14 that is in turn connected electrically with a circuit, not shown, at some remote site for producing an alarm signal that is detected by personnel, such as a nurse. The present invention is particularly useful in a nurse call system utilized by patients to summon help for assistance or fulfill a need for patient care. The switch device 14 is shown in greater detail in FIGS. 2 and 3 and includes an actuator housing 16 having an internal annular cavity for supporting a sleeve 17. The sleeve 17 seats against a bottom wall of the cavity in the housing 16. The top of the cavity is enclosed by a porous air filter 18. Emerging through an opening surrounded by an enlarged boss 19 in a side wall of the housing 16 there is a tubular conductor 21 having internally thereof an insulating sleeve 22. Each of opposite ends of the sleeve 22 is formed with an enlarged radial flange 23 that anchors the sleeve 22 within sleeve 21. A conductor pin 24 electrically interconnects sleeve 17 with sleeve 21. A conductor pin 25 is supported in the central opening of insulating sleeve 22 and provided with a hemispherical electrical contact 26 that is situated within a side wall opening of sleeve 17 in a manner that contact 26 protrudes a slight distance beyond the internal wall face of sleeve 17. Connector 25 is provided with a threaded end portion that extends beyond the insulating sleeve 22 and receives a metal connector 27.

Figure 3:
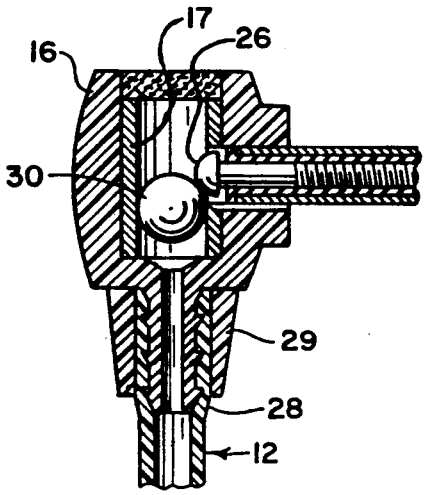
FIG. 3 is a sectional view similar to FIG. 2 and illustrating the actuator ball in a closed circuit position.
Figure 4:
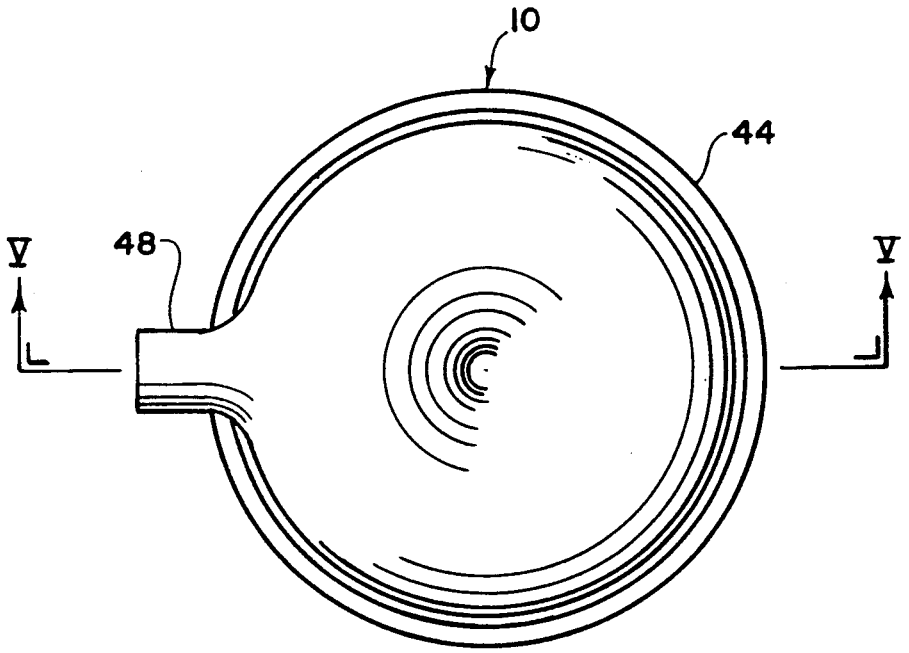
FIG. 4 is a top plan view of the pneumatic bulb as shown in FIG. 1.
Figure 5:
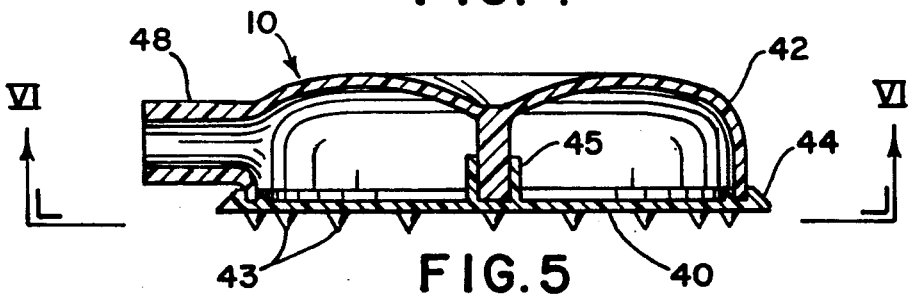
FIG. 5 is a sectional view taken along line V—V of FIG. 4.

A supply of pressurized air is delivered by conduit 12 to an entry duct 28 which comprises an extension of the housing 16. The entry duct has an external surface formed with anchor lugs that can firmly grip by partial penetration of the internal wall face of duct 12 in order to maintain an air tight connection between duct 12 and duct 28. A collar 29 is passed over the external surface of the duct 28 to apply a compressive force to the duct and reinforce the conduit side wall. The internal cavity wherein sleeve 17 is supported in housing 16 is provided with a truncated conical seat surrounding the supply opening in the duct 28 for allowing an actuator ball 30 to seat by gravity against the truncated conical seating surface. ;

As shown in FIG. 3, the actuator ball which can be of a solid metal construction or of a non-metallic core provided with a metallic covering can be displaced from the conical seat through the delivery of a quantity of pressurized air through duct 28 into the area surrounded by the sleeve 17. The ball 30 is displaced by the air from the conical seat into a electrically conductive relationship between the hemispherical head portion 26 of conductor 25 and the sleeve 17. When this occurs, the normally opened circuit condition as depicted by the arrangement of parts in FIG. 2 becomes a normally closed circuit condition as depicted by the arrangement of parts in FIG. 3 and thereby provide a corresponding electrical signal which is detectable by the call system to which the switching device 14 is connected.

The pneumatic bulb 10 as shown in FIGS. 4–7 includes a base plate 40 joined in an air tight fashion with an actuator dome 42 to enclose a volume comprising a pneumatic pump chamber. The base plate 40 and actuator dome 42 are preferably made from an elastomeric material which can be readily molded and welded by suitable, well known techniques for producing the assembled configuration.

Figure 6:
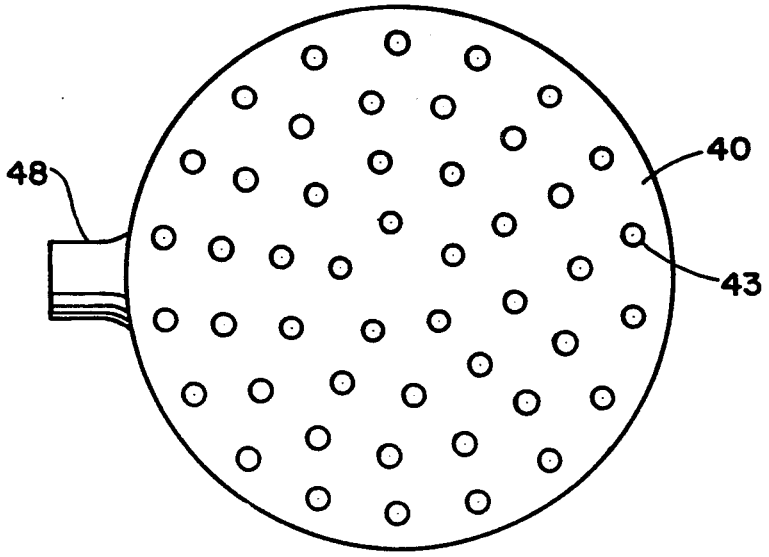
FIG. 6 is a bottom plan view taken along lines VI—VI of FIG. 5.

The base plate 40 preferably takes the form of a flat disk having on one face 40A an array of conical protrusions 43 arranged in the spaced apart relationship shown in FIG. 6. The flat disk configuration is preferred for ease of mold manufacture but oval, egg shaped or rectangular configurations may be used with equal success to provide a uniquely distinguishing configuration that will set apart the nurse call bulb from other pneumatic bulbs also used in the patient care environment. A face surface 40B of the disk which is opposite the protrusions 43 is formed with an upstanding annular rim section 44 extending about the outer periphery of the base plate and central to the rim section there is an upstanding socket 45.

Figure 8:
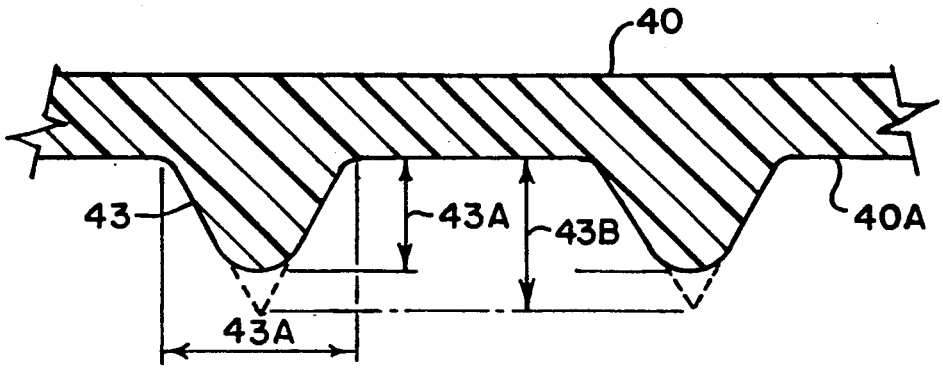
FIG. 8 is an enlarged sectional view of the base plate and support protrusions for the pneumatic bulb according to the present invention.

As can be seen from FIG. 8, the actuator has been designed so that there are no rigid parts that might be damaged or bent by such actions as stepping on the device, accidently running a bed roller over the device, or entrapping it in scissor type arms that are used on devices for raising the head, center or foot of the bed on the overall height or pivoted bedrails. The resilientancy of the truncated conical protrusions 43 has been developed so that the resilientancy of the elastic material from which the base plate is made combined with the shape of the protrusions, reliably establish and maintain frictional contact with a support surface. The truncated conical shape of the protrusions is such that the straight side of each conical wall extends to at least 80% of the height of the corresponding cone, specifically as can be seen in FIG. 8, protrusion 43 has a height 43A that is about 80% of the height of the cone indicated by reference numeral 43B. The truncated shape of the protrusion provides a blunt rounded terminal end which resists elastic deformation while exhibiting good frictional contact with the support surface. The bluntness of the point establishes a sharpness that gives a high unit pressure at the point of contact to achieve the stable frictional contact with the support surface for the bulb. Preferably the maximum diameter of the truncated protrusion corresponds to the same dimension given by the height of the protrusion 43A. Thus, reference numeral 43A has been applied to not only the height of the protrusion but also the maximum diameter of the protrusion.

Figure 7:
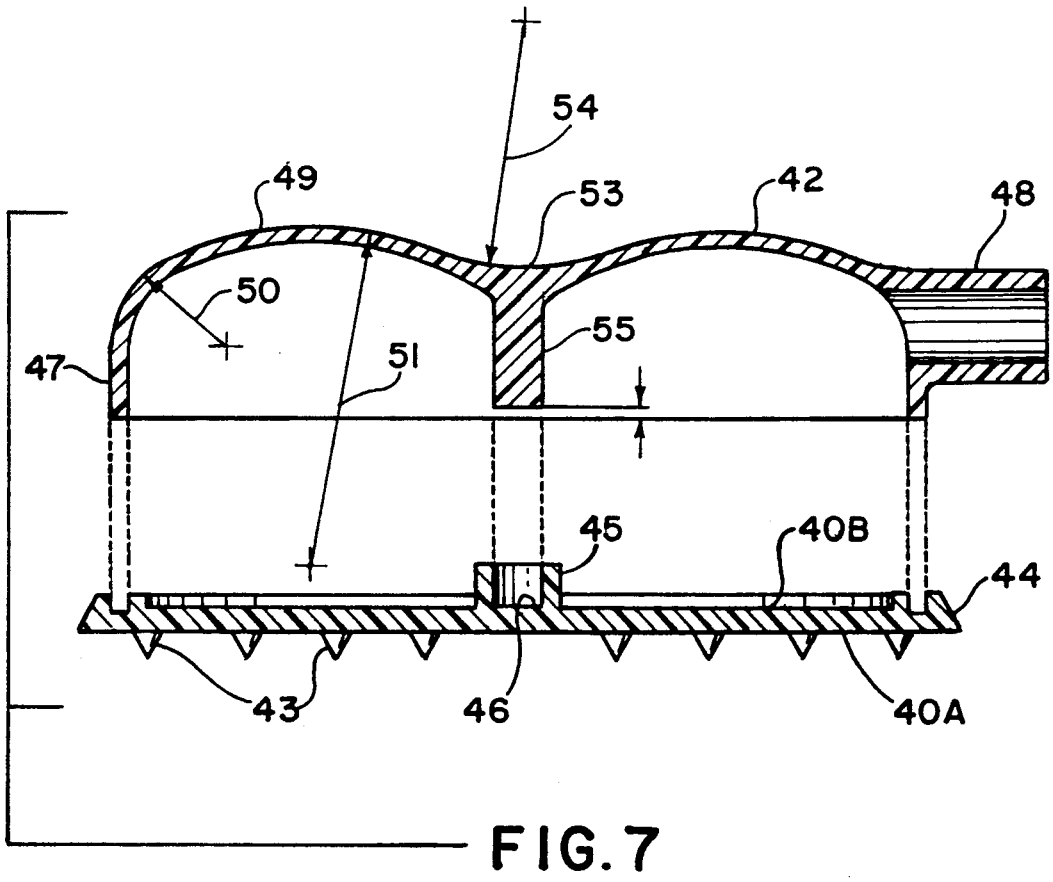
FIG. 7 is an enlarged view of the actuator dome to illustrate the preferred construction thereof according to the present invention.

As can be best seen in FIG. 7, the socket 45 has a floor wall 46 that is contiguous in a plane containing the face surface 40B of the base plate. The annular rim 44 has a floor wall that is depressed a distance below the plane of the floor wall of socket 45. By this construction, the preferred molded configuration for the actuator dome 42 can be supported by the base without imposing stress and strain on the dome which might otherwise impede the sensitivity of the dome to pressures on the external surface of the dome for actuating the nurse call system. The actuator dome includes an annular rim wall section 47 which is of a constant diameter. Protruding from the rim wall section 47 is a tubular wall section 48 forming a connector site for the duct 12. The annular wall 47 forms a rim like boundary to the actuator dome and fits into the annular rim 44 where it is welded in place.

A top wall to the pneumatic bulb is formed by a generally doughnut shaped wall configuration comprised of a circular ring wall section 49 formed of 2 radii identified by reference numerals 50 and 51. Radius 50 defines the transition wall section between the rim wall section 47 and the circular wall section 49. The radius 50 is typically between one third to one forth the length of radius 51. The central area surrounded by the annular wall 47 is formed with a depressed wall section 53 established by a radius identified by reference numeral 54. The length of radius 54 is at least twice the length of radius 50 Depending from inner surface of the actuator dome underlying the depressed wall section 53 is a centrally located post 55. The lower terminal end which does not protrude beyond the lower edge of wall section 47 and thus the terminal end is recessed in the dome a short distance from as measured from a plane containing the lower edge of the wall section 47. When the post 55 is fitted into the socket 45 and rim section is fitted in the base, the dome is supported without distortion to the configuration of the dome established through the radii 50, 51 and 54. This construction of the actuator dome enables the use of wall thicknesses to form the dome that are advantageously thin and can be made from soft pliable elastomeric material so that sensitivity of the dome to external pressure is great. The pneumatic bulb of the present invention is preferably made with a soft plastic material having a durometer measurement of 60 with a tacky plastic surface. The plastic material is preferably selected from the poly vinyl chloride family of plastics with a softening plastisizers added bu without fillers.

Contributing to the sensitivity of the dome is also the provision of the center post 55 which support enables the long continued maintenance of the dome configuration without distortion due to fatigue of the elastic material. The construction of the dome enables a very low profile shape thereby providing a center of gravity very close to the support surface for the dome. It has been found that the dome can be manufactured with an over all height of one inch or less while the outer diameter can be about three and one half inches. When so constructed the pneumatic bulb stays in place on a patients mattress surface particularly when sliding or shifting movement by the patient or the bed positioning occurs.

While the present invention has been described in connection with the preferred embodiments of the various figures, it is to be understood that other similar embodiments may be used or modifications and additions may be made to the described embodiment for performing the same function of the present invention without deviating therefrom. Therefore, the present invention should not be limited to any single embodiment, but rather construed in breadth and scope in accordance with the recitation of the appended claims.

I claim:

1. A pneumatically actuated switching device comprising:

a pneumatic bulb including a base plate for anchoring the bulb by frictional contact with surfaces supported thereby, said base plate further having seal means about an outer periphery thereof, and an actuator dome supported by an outer peripheral annular rim engaged with said base plate for pneumatic sealing with said seal means to define a pneumatic pump chamber, said actuator dome having a generally convex wholly continuous wall forming a circular ring with a concave central portion having an inside diameter projecting to a central depression, a support post integral with and extending from the central depression of the actuator dome on the inside surface thereof for imparting sustained elasticity to the pneumatic pumping chamber acted on by said circular ring, said bulb further including means for conducting a quantity of air pressurized by operation of said dome; and, electrically conductive means responsive to the discharge of a volume of air pressurized by said pneumatic bulb for producing a corresponding electrical signal.

2. The pneumatically actuated switching device according to claim 1 wherein said base plate further includes an array of protrusions for anchoring said bulb.

3. The pneumatic actuated switching device according to claim 1 wherein said base plate includes an upstanding annular rim section and an upstanding socket for supporting said dome.

4. The pneumatic actuated switching device according to claim 1 wherein said convexly extending pneumatic activation wall is joined by a wall section having a first radius to said peripheral annular rim and wherein said activation wall has a circular ring configuration including a wall section defined by a second radii, said first radii being at least three times greater than said second radii.

5. The pneumatic actuated switching device according to claim 4 wherein said activation wall further includes a depressed central wall section surrounded by said circular rim section and defined by a third radii, said first radii being at least two times the distance of said third radii.

6. The pneumatically actuated switching device according to claim 2 wherein said array of protrusions include truncated conical members each have a extended height of about 80% of the corresponding cone height.

7. The pneumatically actuated switching device according to claim 6 wherein said truncated conical members each have a maximum diameter corresponding to the maximum height of the truncated cone.

8. The pneumatically actuated switching device according to claim 6 wherein the truncated conical members each have a sharpness to impart high unit pressure at the point of contact with a support surface.

* * * * *